US005927301A

United States Patent [19]

Richardson

[11] Patent Number: 5,927,301

[45] Date of Patent: Jul. 27, 1999

[54] BEVERAGE CONSERVATION METHOD AND SYSTEM

[75] Inventor: William Elliott Richardson, Buckingham, United Kingdom

[73] Assignee: Cellar Myzer Trading Limited, United Kingdom

[21] Appl. No.: 08/833,942

[22] Filed: Apr. 14, 1997

[30] Foreign Application Priority Data

Apr. 19, 1996 [GB] United Kingdom ..... 9608099

[51] Int. Cl.[6] ..... B08B 3/00; B08B 9/00; B08B 9/02

[52] U.S. Cl. ..... 134/22.12; 134/22.18; 134/166 C; 134/168 C; 134/169 C

[58] Field of Search ..... 134/22.11, 22.12, 134/22.18, 166 C, 168 C, 169 C; 141/1, 5, 18, 35; 222/148, 153.11

[56] References Cited

FOREIGN PATENT DOCUMENTS 2290831 10/1996 United Kingdom .

*Primary Examiner*—Zeinab El-Arini
*Attorney, Agent, or Firm*—Ira S. Dorman

[57] ABSTRACT

During the cleaning of a beverage dispense line from a beverage container to a beverage dispenser, beverage is conserved by transferring beverage from the beverage dispense line to a beverage holding vessel, other than the beverage container, prior to cleaning of the dispense line. The beverage dispense line is then cleaned and the beverage from the beverage holding vessel is subsequently returned to the beverage dispense line.

26 Claims, 1 Drawing Sheet

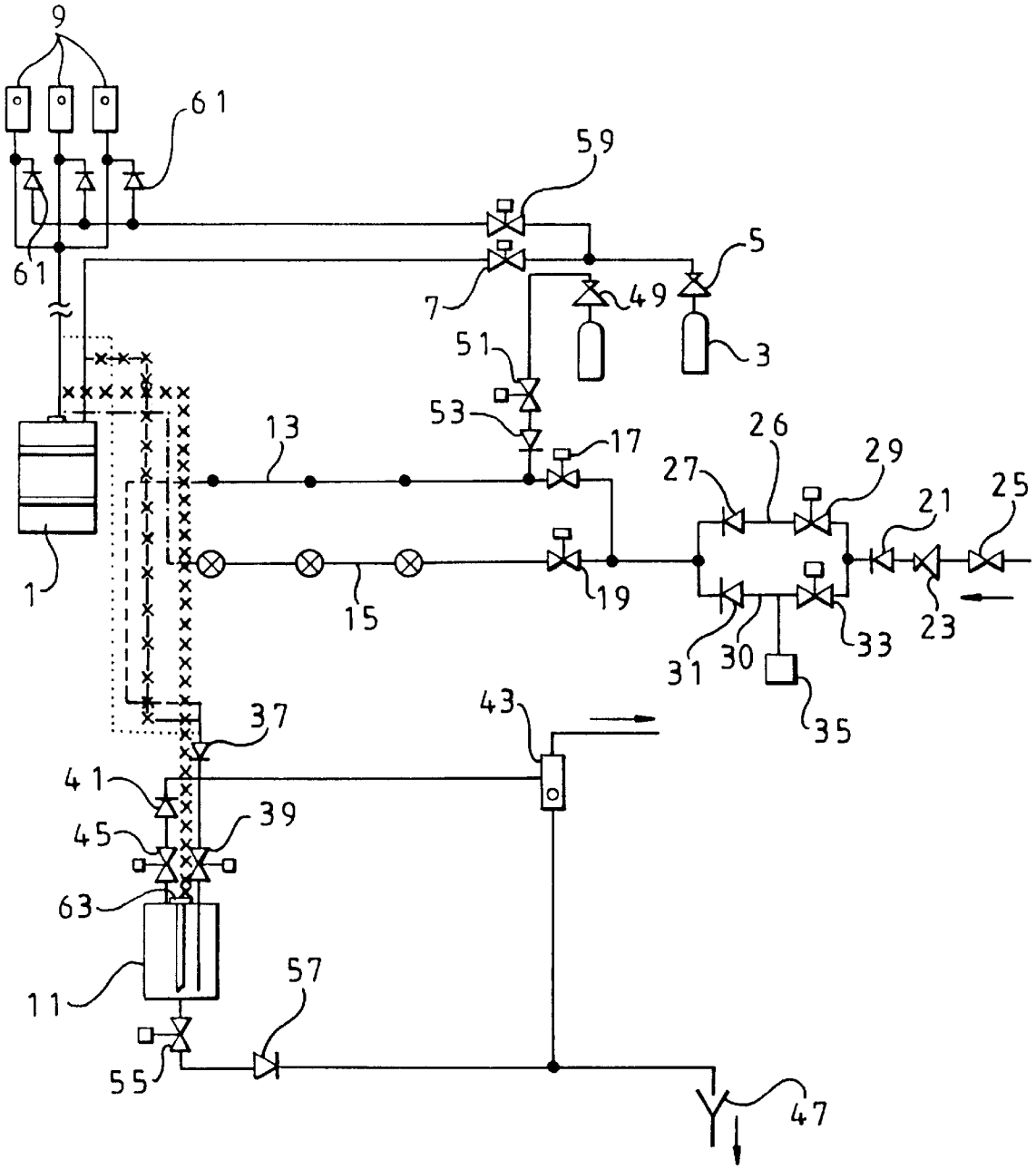
9
61
61
59
5
7
49
3
51
53
17
13
26
29
27
21
25
1
15
19
23
31
30
33
35
37
43
41
39
45
63
11
57
55
47

BEVERAGE CONSERVATION METHOD AND SYSTEM

The present invention relates to a beverage conservation method and system and, more particularly, relates to a beverage conservation method and system for reducing wastage of beverage during cleaning.

BACKGROUND TO THE INVENTION

Beverage dispense systems, for example for alcoholic beverages such as beers, lagers, stouts and ciders, require regular cleaning and this involves emptying beverage in the beverage carrying pipes or lines in order to pass cleaning solution such as detergent or the like therethrough. It is generally not permitted to return the beverage from the pipes to a beverage container with the result that the beverage in the pipes is usually discarded.

OBJECT OF THE INVENTION

It is an object of the present invention to provide a beverage conservation method and system which avoids or minimises wastage of beverage during cleaning.

SUMMARY OF THE INVENTION

According to one aspect of the present invention there is provided a method of conserving a beverage during the cleaning of a beverage dispense line from a beverage container to a beverage dispenser, the method including the steps of:

transferring beverage from the beverage dispense line to a beverage holding vessel, other than the beverage container, prior to cleaning of the dispense line;

cleaning the beverage dispense line; and returning the beverage from the beverage holding vessel to the beverage dispense line subsequent to cleaning of the dispense line.

According to another aspect of the present invention there is provided a beverage conservation system for use during the cleaning of a beverage dispense line from a beverage container to a beverage dispenser, the system comprising:

a beverage holding vessel, other than the beverage container, for receiving beverage from the beverage dispense line prior to cleaning of the dispense line; and means for returning the beverage from the beverage holding vessel to the beverage dispense line subsequent to cleaning of the dispense line.

Gas supply means may be provided for urging the beverage from the beverage dispense line into the beverage holding vessel. The gas supply means may be used to pressurise the beverage within the holding vessel.

Gas supply means may be provided for urging the beverage from the holding vessel to the beverage dispense line.

Means may be provided for washing the interior of the beverage holding vessel with water prior to introduction of the beverage from the dispense line. Additionally, means may be provided for washing the interior of the beverage holding vessel with cleaning solution prior to washing with water. Gas supply means may be provided for assisting in emptying the water and/or the cleaning solution from the holding vessel by urging the liquid out of the vessel.

Means may be provided for cleaning the beverage holding vessel once used. The cleaning means may include means for washing the interior of the vessel with a cleaning solution, emptying the cleaning solution from the vessel, washing the interior of the vessel with water and emptying the water from the vessel. Gas supply means may be provided for assisting in emptying the cleaning solution and the water from the holding vessel by urging the liquid out of the vessel. The gas supply means may be used to pressurise the beverage holding vessel subsequent to cleaning.

BRIEF DESCRIPTION OF THE DRAWING

For a better understanding of the present invention and to show more clearly how it may be carried into effect reference will now be made, by way of example, to the accompanying drawing which shows one embodiment of a beverage conservation method and system according to the present invention.

DESCRIPTION OF PREFERRED EMBODIMENT

The figure shows a beverage container 1, such as a keg, having an inlet for pressurising dispense gas from a gas container 3, such as a gas bottle. The line from the gas container 3 to the beverage container 1 incorporates a pressure reducing valve 5 and a normally open solenoid valve 7.

The various control operations described herein can be effected manually and/or under control of a sequence controller (not shown).

In normal use, pressurised beverage is urged from the beverage container 1 along one or more product dispense lines to one or more beverage dispense taps 9, three being shown in the figure. The product dispense line(s) are generally connected to the container 1 by way of quick release couplings (not shown) and the line(s) may incorporate any of the features normally incorporated in such lines, such as coolers, fob traps and so-called pythons.

Prior to cleaning in the normal way, beverage is drained from the product dispense lines into a beverage holding vessel 11. This is effected by activating the solenoid valve 7 to close the same and thereby to shut down the supply of dispense gas to the beverage container 1. The beverage holding vessel is then connected, for example manually by way of the quick release coupling arrangement, to a holding vessel ring main 13 by way of the dashed line shown in the figure.

The holding vessel ring main 13 and a line cleaning ring main 15 are each connected, by way of normally closed solenoid valves 17 and 19, respectively, to a supply of water, for example by way of a non-return valve 21, a pressure reducing valve 23 and an isolating valve 25. Downstream of the non-return valve 21, the water supply is temporarily divided into parallel lines. One parallel line 26 incorporates a non-return valve 27 and a normally closed solenoid valve 29, while the other parallel line 30 incorporates a non-return valve 31 and a normally closed solenoid valve 33. An automatic dosing pump 35 is connected to the parallel line 30 intermediate the non-return valve 31 and the solenoid valve 33 to introduce line cleaner (detergent) into the water supply passing through line 30 at a desired concentration.

Thus, depending on the state of the solenoid valves 29 and 33, either clean water or diluted line cleaner can be supplied to the holding vessel ring main 13 and/or the line cleaning ring main 15 by way of the solenoid valves 17 and 19.

The solenoid valves 29 and 17 are activated to introduce clean water into the holding vessel 11 by way of a non-return valve 37 and a normally closed solenoid valve 39, which is also activated. Air is simultaneously vented from the holding vessel to atmosphere by way of a non-return valve 41 and a water trap 43 by activating a normally closed solenoid valve 45. Any liquid in the vented air is separated in the water trap 43 and lead away to a drain 47. Valves 39 and 45 are activated for a time sufficient for the holding vessel 11 to fill with water.

The valves 39 and 45 are then de-activated, together with valves 17 and 29, to cause them to close and pressurised gas, for example dispense gas or carbon dioxide, is supplied to the holding vessel ring main 13 by way of a pressure reducing valve 49 a normally closed solenoid valve 51 and a non-return valve 53. Solenoid valve 39 and a normally closed solenoid valve 55 are then activated to evacuate the contents of the holding vessel 11 to the drain 47 by way of the valve 55 and a non-return valve 57. The valves 39 and 55 are activated for a sufficient time for the contents of the holding vessel 11 to drain.

The valves 39 and 55 and the valve 51 are then de-activated to cause them to close and the holding vessel 11 is ready to receive beverage from the product dispense lines.

In order to initiate drainage of the product dispense lines, the sequence controller prompts a user manually to re-connect the quick release coupling of the product dispense lines from the beverage container 1 to the inlet of the holding vessel 11 by way of valves 37 and 39 as indicated by a dotted line in the figure. Dispense gas is then supplied to the region of the dispense taps 9 from the gas container 3 by way of a normally closed solenoid valve 59 and a non-return valve 61 in the region of each dispense tap, by activating the solenoid valve 59. The vent valve 45 and the inlet valve 39 are then activated and beverage flows from the product dispense lines into the holding vessel 11.

The operation described above works well with free-flow dispense systems, but alternative methods may be required for pump assisted free flow systems and for metered systems. For pump assisted systems, the downstream side of the pump is connected to the holding vessel inlet and the priming function of the pump is used additionally to evacuate the product dispense lines between the beverage container 1 and the pump. For metered systems, the downstream side of the meter is connected to the holding vessel inlet and the priming function of the meter pump is used additionally to evacuate the product dispense lines between the beverage container 1 and the meter pump.

The vent valve 45 is then de-activated to cause it to close and the holding vessel is allowed to pressurise with dispense gas for a predetermined time before the inlet valve 39 is de-activated to close the same.

The valve 59 is then closed and the quick release coupling can be disconnected, for example manually, to leave the holding container 11 functioning as a temporary beverage container without the beverage having been returned to the beverage container 1.

The quick release coupling is then connected, for example manually, to the line cleaning ring main 15 as illustrated by the dot-dashed line in the figure for cleaning the product dispense lines in the normal way. That is, the solenoid valves 19 and 29 are activated to introduce water into the product dispense lines and the sequence controller prompts the user to bleed water through the product dispense lines and through the taps 9 by operating the taps until the water runs clear. The user then confirms to the sequence controller that this phase has been completed, for example by pressing a "PROCEED" button on the sequence controller, and valves 19 and 29 are de-activated to close the same and valve 19 is subsequently re-activated, together with valve 33, to introduce dilute cleaning solution into the product dispense lines. The sequence controller prompts the user to bleed cleaning solution through the product dispense lines by operating the taps 9 until cleaning solution passes out of the taps.

The cleaning solution is allowed to remain in the product dispense lines for a predetermined time, for example in accordance with the advice of the beverage manufacturer. The predetermined time may be, for example, twenty minutes. If desired, an amount of cleaning solution may be run off through the taps part way, for example about half way, through the predetermined time to facilitate the dislodging of deposits in the dispense system.

After the predetermined time has elapsed, the user initiates further processing, for example by pressing the "PROCEED" button on the sequence controller. Valves 19 and 33 are de-activated to cause the same to close and valve 19 is then re-activated, together with valve 29, to introduce clean water into the product dispense lines. The sequence controller prompts the user to bleed water through the product dispense lines by operating the taps 9 until clean water passes out of the taps and all traces of cleaning solution have been flushed away. The valves 19 and 29 are then de-activated to close the same.

With the product dispense lines clean and filled with water, beverage contained under pressure in the holding vessel 11 can be re-introduced. The sequence controller prompts the user to disconnect the quick release coupling from the line cleaning ring main 15 and to connect the coupling to a connector 63 provided on the holding vessel 11 as shown by the line of x's in the figure, the connector 63 communicating with the lower region of the interior of the holding vessel to facilitate removal of the beverage therefrom. Additionally, the dispense gas container 3 is coupled to the holding vessel inlet by way of valves 37 and 39 as shown by the x-dashed line in the figure.

When this has been completed, the user initiates beverage recovery, for example by pressing the "PROCEED" button on the sequence controller. The solenoid valve 7 in the dispense gas line is activated to open the same together with inlet valve 39 of the holding vessel 11 and the user operates the taps 9 to bleed beverage from the holding vessel into the product dispense lines and any features, such as fob traps, incorporated therein.

Once the contents of the holding vessel 11 have been evacuated into the product dispense lines, the user is prompted to disconnect the quick release coupling from the connector 63 and to disconnect the dispense gas container 3 from the inlet to the holding vessel 11 and to connect the same to the container 1.

Beverage can then be dispensed from the container 1 in the normal way without the need to first dispense sufficient beverage to refill the product dispense lines.

The holding vessel 11 can then be cleaned for future use. Indeed, the sequence controller may be programmed to de-activate the solenoid valve 7 in the dispense gas line after a predetermined time, for example thirty minutes, if the cleaning phase has not been initiated in order to ensure that the holding vessel is cleaned.

Cleaning is initiated by the user coupling the holding vessel ring main 13 to the inlet of the holding vessel by way of valves 37 and 39 and by, for example, pressing the "PROCEED" button on the sequence controller (thereby also disabling de-activation of the valve 7).

Valves 17 and 29 are activated to allow the passage of clean water into the holding vessel ring main 13 and the valves 39 and 45 are then activated for a sufficient time to allow the holding vessel to fill with water. The valves 17, 29, 39 and 45 are then de-activated to close the same.

The valve 51 is then activated to supply gas under pressure to the inlet of the holding vessel 11 and valves 39 and 55 are activated to evacuate the contents of the holding vessel to the drain 47. The valves 39 and 55 are activated for a sufficient time for the contents of the holding vessel to drain. The valves 39 and 55 and the valve 51 are then de-activated to cause them to close.

Valves 17 and 33 are then activated to allow the passage of cleaning solution into the holding vessel ring main 13 and the valves 39 and 45 are then activated for a sufficient time to allow the holding vessel to fill with cleaning solution. The valves 17, 33, 39 and 45 are then de-activated to close the same.

The valve 51 is then activated to supply gas under pressure to the inlet of the holding vessel 11 and valves 39 and 55 are activated to evacuate the cleaning solution in the holding vessel to the drain 47. The valves 39 and 55 are activated for a sufficient time for the contents of the holding vessel to drain. The valves 39 and 55 and the valve 51 are then de-activated to cause them to close.

The holding vessel is then washed out by filling the vessel with water and the n subsequently emptying the same. This is effected by activating valves 17 and 29 to allow the passage of clean water into the holding vessel ring main 13 and then activating valves 39 and 45 for a sufficient time to allow the holding vessel to fill with water. The valves 17, 29, 39 and 45 are then de-activated to close the same.

The valve 51 is then activated to supply gas under pressure to the inlet of the holding vessel 11 and valves 39 and 55 are activated to evacuate the contents of the holding vessel to the drain 47. The valves 39 and 55 are activated for a sufficient time for the contents of the holding vessel to drain. The valve 55 is then de-activated to close the drain, but valves 39 and 51 are maintained activated for an additional predetermined time to permit a slight positive pressure to build up in the holding vessel 11. The valves 39 and 51 are then de-activated in sequence to maintain the slight positive pressure in the holding vessel 11.

The holding vessel ring main 13 and the line cleaning ring main 15 can be used to service a plurality of containers 1, each having separate product dispense lines and separate holding vessels 11. This facility is indicated by the multiple points on the mains 13 and 15 shown in the figure. Depending on the complexity of the sequence controller, the controller may be able to handle more than one cleaning operation at a time or, alternatively, multiple cleaning operations may need to be effected manually.

I claim:

1. A method of conserving a beverage during cleaning of a beverage dispense line from a beverage container to a beverage dispenser, the method including the steps of:

transferring beverage from the beverage dispense line to a beverage holding vessel, other than the beverage container, prior to cleaning of the dispense line;

cleaning the beverage dispense line; and returning the beverage from the beverage holding vessel to the beverage dispense line subsequent to cleaning of the dispense line.

2. A method according to claim 1, wherein beverage from the beverage dispense line is urged into the beverage holding vessel under gas pressure from gas supply means.

3. A method according to claim 2, wherein the gas supply means is used to pressurise the beverage within the holding vessel.

4. A method according to claim 1, wherein beverage from the holding vessel is urged to the beverage dispense line under gas pressure from gas supply means.

5. A method according to claim 1, wherein an interior surface of the beverage holding vessel is washed with water prior to introduction of the beverage from the dispense line.

6. A method according to claim 5 and including the step of emptying the water from the holding vessel by urging liquid out of the vessel under gas pressure.

7. A method according to claim 5, wherein the interior of the beverage holding vessel is washed with cleaning solution prior to washing with water.

8. A method according to claim 7 and including the step of emptying the cleaning solution from the holding vessel by urging the liquid out of the vessel under gas pressure.

9. A method according to claim 1 and including the step of cleaning the beverage holding vessel once used.

10. A method according to claim 9, wherein the cleaning step includes washing an interior surface of the vessel with a cleaning solution, emptying the cleaning solution from the vessel, washing the interior surface of the vessel with water and emptying the water from the vessel.

11. A method according to claim 10, wherein the cleaning solution and the water are emptied from the holding vessel by urging the liquid out of the vessel under gas pressure.

12. A method according to claim 11 and including the step of pressurising the beverage holding vessel subsequent to cleaning.

13. A beverage conservation system for use during the cleaning of a beverage dispense line from a beverage container to a beverage dispenser, the system comprising:

a beverage holding vessel, other than the beverage container, for receiving beverage from the beverage dispense line prior to cleaning of the dispense line; and means for returning the beverage from the beverage holding vessel to the beverage dispense line subsequent to cleaning of the dispense line.

14. A system according to claim 13, wherein gas supply means is provided for urging the beverage from the beverage dispense line into the beverage holding vessel.

15. A system according to claim 14, wherein the gas supply means is used to pressurise the beverage within the holding vessel.

16. A system according to claim 13, wherein gas supply means is provided for urging the beverage from the holding vessel to the beverage dispense line.

17. A system according to claim 13, wherein means is provided for washing the interior of the beverage holding vessel with water prior to introduction of the beverage from the dispense line.

18. A system according to claim 17, wherein gas supply means is provided for assisting in emptying the water from the holding vessel by urging the liquid out of the vessel.

19. A system according to claim 17, wherein means is provided for washing the interior of the beverage holding vessel with cleaning solution prior to washing with water.

20. A system according to claim 19, wherein gas supply means is provided for assisting in emptying the cleaning solution from the holding vessel by urging the liquid out of the vessel.

21. A system according to claim 13, wherein means is provided for cleaning the beverage holding vessel once used.

22. A system according to claim 21, wherein the cleaning means includes means for washing an interior surface of the vessel with a cleaning solution, emptying the cleaning solution from the vessel, washing the interior surface of the vessel with water and emptying the water from the vessel.

23. A system according to claim 22, wherein gas supply means is provided for assisting in emptying the cleaning solution and the water from the holding vessel by urging the liquid out of the vessel.

24. A system according to claim 23, wherein the gas supply means is used to pressurise the beverage holding vessel subsequent to cleaning.

25. A method of conserving a beverage during cleaning of a beverage dispense line from a beverage container to a beverage dispenser, the method including the steps of:

transferring beverage from the beverage dispense line to a beverage holding vessel, other than the beverage container, prior to cleaning of the dispense line, the beverage from the beverage dispense line being urged into the beverage holding vessel under gas pressure from gas supply means;

cleaning the beverage dispense line; and returning the beverage from the beverage holding vessel to the beverage dispense line subsequent to cleaning of the dispense line, beverage from the holding vessel being urged to the beverage dispense line under gas pressure from gas supply means.

26. A beverage conservation system for use during cleaning of a beverage dispense line from a beverage container to a beverage dispenser, the system comprising:

a beverage holding vessel, other than the beverage container, for receiving beverage from the beverage dispense line prior to cleaning of the dispense line;

means for returning the beverage from the beverage holding vessel to the beverage dispense line subsequent to cleaning of the dispense line; and gas supply means for urging the beverage from the beverage dispense line into the beverage holding vessel, and for urging the beverage from the holding vessel to the beverage dispense line.

* * * * *